United States Patent [19]

Hannon

[11] Patent Number: 4,589,687

[45] Date of Patent: May 20, 1986

[54] IDENTIFICATION CARD METHOD AND APPARATUS

[75] Inventor: Donald F. Hannon, Waite Hill, Ohio

[73] Assignee: Graphic Laminating Inc., Cleveland, Ohio

[21] Appl. No.: 513,300

[22] Filed: Jul. 13, 1983

[51] Int. Cl.[4] ..... B42D 15/00

[52] U.S. Cl. ..... 283/94; 283/74; 283/77; 283/904; 283/109

[58] Field of Search ..... 283/74, 77, 94, 108, 283/109, 900, 904; 156/268

[56] References Cited

U.S. PATENT DOCUMENTS

| | | | |
|---|---|---|---|
| 3,204,354 | 9/1965 | Berger | 283/77 |
| 3,413,171 | 11/1968 | Hannon | 283/77 |
| 4,236,332 | 12/1980 | Domo | 283/900 |
| 4,278,722 | 7/1981 | Hoppe et al. | 283/94 |
| 4,310,591 | 1/1982 | Lee et al. | 283/74 |
| 4,322,461 | 3/1982 | Raphael | 283/77 |
| 4,325,196 | 3/1982 | Gauch et al. | 283/77 |

*Primary Examiner*—Paul A. Bell
*Assistant Examiner*—Paul M. Heyrana, Sr.
*Attorney, Agent, or Firm*—Watts, Hoffmann, Fisher & Heinke Co.

[57] ABSTRACT

A tamper proof identification card. The disclosed card is made from a core of safety paper sandwiched between two top and bottom layers of polyester coated with polyethylene. The safety paper is bounded at its periphery by a polyester border similar to the top and bottom layers. The layered card is heat and pressure treated to encapsulate the paper. Should the seal be inadequate, any attempts to modify the information marked on the safety paper will be readily apparent.

10 Claims, 5 Drawing Figures

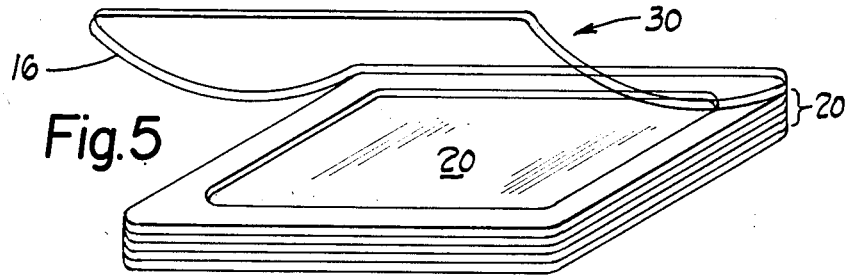
Fig. 5
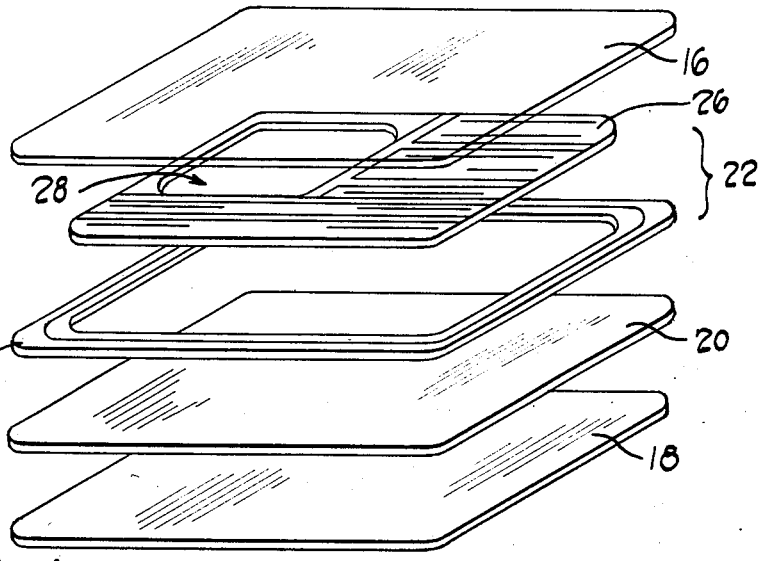
Fig. 4
Fig. 1
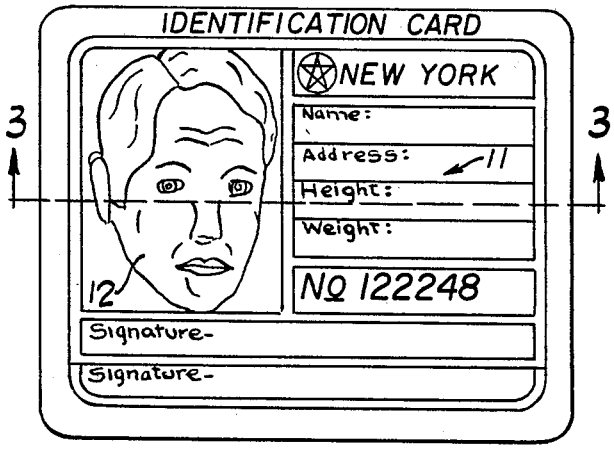
Fig. 2
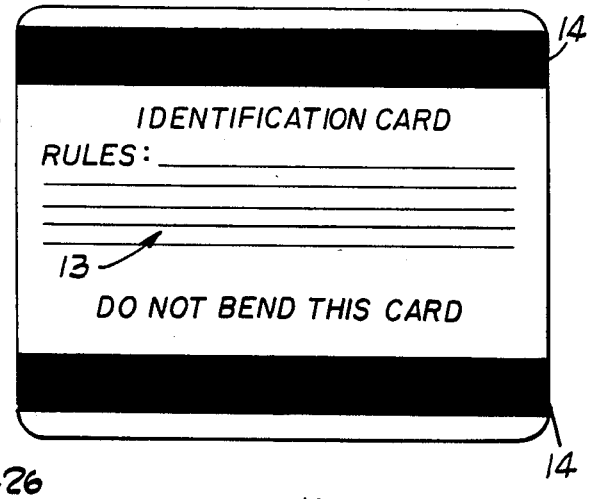
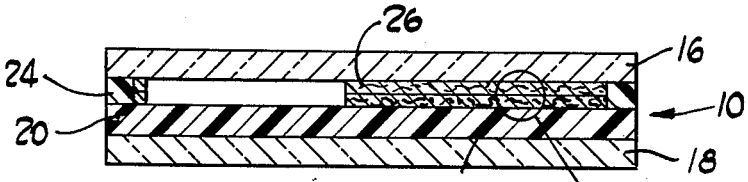
Fig. 3
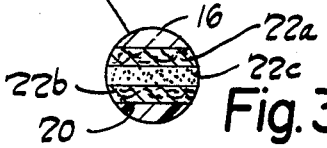
Fig. 3A

IDENTIFICATION CARD METHOD AND APPARATUS

TECHNICAL FIELD

The present invention concerns identification cards and more particularly relates to method and apparatus for a tamper proof identification card.

BACKGROUND ART

The use of small plastic identification cards has become increasingly common. Bank or department store credit cards are often used instead of cash or checks in making retail purchases and bank cards are used to perform various banking transactions at automatic tellers. Driver's licenses, specialized identification cards, employee identification, industrial process control, and membership cards are other uses for these plastic cards.

A common feature to all of these cards is that they entitle the owner or possesser of those cards certain privileges. As the use and acceptance of these cards increases, the likelihood and potential gain in counterfeiting or tampering with those cards also increases. Various schemes have been proposed to make plastic card less susceptible to tampering.

U.S. Pat. No. 3,413,171 to Hannon, which issued Nov. 26, 1978, entitled "Process of making identification cards" and U.S. Pat. No. 3,417,497 to Hannon, which issued Dec. 24, 1968, entitled "Identification card" disclose an identification card which is less susceptible to tampering than its predecessors. The card includes a core which is either polyethylene or paper coated on both surfaces by polyethylene. The core is bounded by a polyester envelope which is bonded to the core by polyethylene layers. Identifying indicia is applied to one of the bonded surfaces. During fabrication of the identification card, it is pressure and heat treated so that the polyethylene of the core and the polyethylene adhered to the polyester becomes fused and the indicia becomes suspended within and encased by the fused polyethylene.

When properly formed, the card becomes tamper proof since any attempt to heat or chemically treat the card to gain access to the indicia would result in the ink flowing, giving an indication that the card has been tampered with. While the procedures described in U.S. Pat. No. 3,413,171 and 3,417,497 have achieved some degree of commercial success, in practice the procedures outlined in those patents often are not properly performed with the result that cards become susceptible to tampering.

The failure to achieve tamper proof cards is due to the fact that people who operate the laminating machines which fabricate the cards often do not properly control the temperature and pressure as the card is fabricated. Without proper controls the polyethylene will not fully fuse and the floating effect whereby the ink becomes embedded in the polyethylene is not achieved and printing can be altered or an I.D. photograph can be replaced.

In Europe, bank machine cards have been fabricated each using a layer of so-called "bank note" paper sandwiched between two layers of vinyl. The identifying indicia is applied directly to the note paper and any attempt to tamper with the paper is thought to be readily apparent. The European bank cards, however, exhibit certain shortcomings. These cards tend to peel and split apart. If properly formed, the paper adheres quite nicely to the vinyl layers but is not strong enough to withstand the treatment a typical card receives. The cards tend to split in half rendering them useless for many purposes. If the card gets wet, liquid tends to flow into the paper core, thus accelerating card deterioration.

A vinyl card is subjected to relatively large but naturally occurring temperature variations, other problems are manifested. If a vinyl card becomes too warm, embossments formed in it tend to disappear. As a consequence and as an example, the card becomes ineffective for such purposes as credit charge form imprinting.

When a vinyl card is cold it becomes brittle and is quite susceptible to cracking and splitting. As an example of one consequence, vinyl cards have been known to fail when workers "clock in" on cold mornings. Since many industries now use computerized production control, card failures during clock ins have resulted in part or all of computerized production controls being disrupted.

From the above, it is apparent that there is a need for a tamper proof, long lasting identification card which avoids the difficulties associated with prior identification cards. The card should be flexible, durable and attractive if it is to be accepted by card users and consumers who have been frustrated by the shortcomings of prior identification cards.

DISCLOSURE OF THE INVENTION

The disadvantages and deficiencies outlined above with respect to the prior art are overcome by the ultilization of a flexible, durable, yet tamper proof identification card constructed in accordance with the present invention. This card will not crack under the use or temperature variations which have caused cracking in prior cards. Even if the card is improperly fabricated the use of safety paper makes it less susceptible to tampering.

The identification card constructed in accordance with the invention includes a core of safety paper to which identifying marks can be affixed. These marks will typically be name, address, etc. A plastic border abuts and bounds the paper core with the border having a thickness substantially the same as the paper core. The combination of the plastic border and safety paper core is then sandwiched between an opaque flexible backing layer and a transparent flexible covering layer.

The safety paper is also known under the designation bank note paper and is a specially constructed paper which resists tampering by clearly indicating a tamperer's efforts. This paper has previously been used for checks, negotiable instruments, stock certificates and the like. If the card is improperly fabricated and a person desiring to tamper with the card gains access to the central core, his efforts will be frustrated by the tamper proof safety paper. The plastic border protects the paper from contact with the elements and also bonds the backing and cover layers to avoid splitting of the card.

The preferred safety paper is bonded to a second layer formed of manifold paper which gives the paper enhanced flexing capability. Without this backing layer of additional paper, the safety paper tends to wrinkle or crack inside its plastic envelope.

In accordance with a preferred embodiment of the invention, the border material, as well as the flexible backing material, is made from an opaque flexible polyester layer adhered to a polyethylene adhesive layer. When heated, the polyethylene flows and melds with polyethylene from other layers of the identification card. The border and backing layer are press and heat treated to fuse them together before the paper core is placed inside the border.

The covering layer is transparent and also made from a thin layer of polyester with a single layer of polyethylene for an adhesive. This transparent covering will typically be bonded to the identification card adjacent a single edge to form a flap so that the paper may be encoded with information and/or an identifying photograph of the card user may be placed inside the flexible polyethylene border prior to sealing the cover by heat and pressure treatment.

The backing layer of opaque material can also include marking or printing on reverse or opposite surface spaced from the core. This printing is typically applied early in the identification card fabrication process. When printing is applied to the opposite side of the backing, the backing includes a polyethylene layer which is then covered with a separate transparent covering which is again heat and pressure sealed over the printing. The printing affixed to this opposite side of the backing material can include a word message as well as codes such as bar codes. Once the transparent covering is applied to this backing, magnetic stripes are applied, if desired, and the stripes are encoded with other machine readable information.

From the above it should be appreciated that one object of the invention is an improved, tamper proof identification card which is flexible and can withstand the treatment typically given such a card without deterioration. This and other objects and advantages of the invention will become better understood when a detailed description of a preferred embodiment of the invention is discussed in conjunction with the accompanying drawings.

BRIEF DESCRIPTION OF THE DRAWINGS

FIG. 1 is a plan view of an identification card constructed in accordance with the present invention;

FIG. 2 is a back plan view of the FIG. 1 card;

FIG. 3 is a sectional view of the card taken along the line 3—3 in FIG. 1;

FIG. 4 is an exploded perspective view of the card showing a sequence of layers which make up the card; and FIG. 5 is a perspective view of the card before a core is inserted.

BEST MODE FOR CARRYING OUT THE INVENTION

Turning now to the drawings there is illustrated an identification card 10 which can serve many functions and is typically encoded with a variety of information regarding the user and/or the privileges accompanying ownership of the card. The particular card 10 illustrated in FIGS. 1 and 2 is a generally rectangular shaped card with curved corners having identifying indicia 11 marked on a front surface (FIG. 1) as well as a photo 12 of the owner of the card. The back (FIG. 2) of the card may include further identifying markings 13 or may include information common to all users of the card which will not vary from card to card. The particular identification card illustrated in FIG. 2 includes two magnetic stripes 14 which can be encoded with a high strength magnetic field to further identify the user.

As seen in FIGS. 3 and 4 the card 10 is a composite fabricated from a multiple number of layers of a variety of materials. A top 16 and bottom 18 layer are both transparent and form an envelope about two inner or core layers 20, 22. A first of the core layers 20 is a sheet of opaque material which serves as a backing member for the second core layer 22.

This second core layer 22 is made up of a number of different components which in combination form an important feature of the present invention. The second core layer 22 includes a thin plastic border 24 having the same outside dimensions as the opaque plastic layer 20. This border 24 bounds and abuts a paper core 26 onto which the identifying or information carrying indicia 11 shown in FIG. 1 is applied. This paper core 26 is made from so-called safety paper which is also designated as bank note paper. This paper typically includes a unique design or pantograph, as well as a water mark, to render more visible any attempt at tampering indicia applied to the paper. U.S. Pat. No. 3,876,496 entitled "Method and Means for Protecting Documents", which issued on Apr. 8, 1975 to Lozano discloses one method for producing safety paper and the disclosure of that patent is incorporated herein. The Lozano patent is noted to illustrate one type of safety paper but as noted in the patent, other types of safety paper are known and are suitable for use in conjunction with the present invention.

In the disclosed identification card 10, the paper core 26 defines a through passage 28 of sufficient dimensions to allow the picture 12 to be inserted into the card 10. The thickness of the border 24, the paper core 26 and the picture 12 are preferably approximately the same so that the second core layer 22 is uniform in thickness. In the preferred embodiment this thickness is 9 mils.

The illustrated construction serves to encapsulate the paper core 26 inside the region defined by the first transparent layer 16, the backing layer 20 and the border 24. Since these materials are preferably constructed using flexible plastic which can be bent without deformation, the identification card 10, having the disclosed structure, is better suited for an ID card than a similarly shaped vinyl card.

The top and bottom transparent layers 16, 18, the backing layer 20, and the border 24 are all constructed from a polyester plastic having at least one surface coated with a polyethylene layer which serves as an adhesive for the polyester. The top and bottom layers 16, 18 are constructed from a single layer of clear polyester with an inner layer of the adhesive polyethylene. In accordance with a preferred construction, these so-called over laminant layers have a 3 mil thick layer of polyester with a 1½ mil layer of polyethylene. These over laminants include only a single layer of polyethylene since they are to be bound, top and bottom, to the inner core layers 20, 22. The border 24 and backing layer 20 are each constructed using an inner layer of 3 mil thick white polyester with 3 mil outer polyethylene layers bounding each side.

The material for the top and bottom 16, 18 as well as border 24 and backing 20 layers can be commercially purchased from the American Can Company, 5300 Dobeckman Avenue, Cleveland, Ohio. This material is available in various thicknesses which can be varied depending upon the desired ultimate thickness of the identification card 10. For a further definition of this material, reference is made to U.S. Pat. Nos. 3,413,171 and 3,417,497 discussed in the Background section of this disclosure. Those two patents are expressly incorporated herein by reference.

The flexibility and durability of the polyethylene coated polyester make it a superior card component. It will maintain its flexibility from minus 50° to plus 350° fahrenheit and does not crack or break in the coldest weather. It does not become brittle with age nor will it fade or change color.

The safety paper is not quite so durable. To make it more suitable as a core material, the safety paper is mounted to a manifold or onion skin paper layer 22b using dry mount tissue 22c. The dry mount tissue is tacky on both its surfaces so that both the safety paper 22a as well as the manifold paper 22b sticks to the dry mount tissue to form a 3 ply paper core element. This 3 ply construction is shown in the enlarged view (FIG. 3A) of FIG. 3. The manifold paper, like the safety paper, is available from the Mead Corporation of Dayton, Ohio while the dry mount tissue is available from the Transel Wrap Company.

Use of the 3 ply construction produces paper core elements 26 which can respectively be flexed without damage. A single ply of safety paper is susceptible to damage if it is flexed without the manifold paper backing. Thus, an identification card 10 using only the safety paper would remain tamper proof but after extended use, the core 26 might be less legible due to the wrinkling and/or tearing of the paper inside the enclosure defined by the plastic layers. The three ply paper is more durable while, of course, still giving a clear indication if attempts are made to tamper with the information printed on the safety paper.

The photographic paper from which the picture is made does not exhibit the problems that the safety paper experiences so that any commercially available photographic paper, such as instant photo print paper from the Polaroid Company, is suitable for displaying the picture 12.

The process steps in fabricating the identification card 10 are now described. As a first step, the individual plastic layers making up the identification card are printed. Printing is applied to only a front surface of the border 24 and a back or reverse side of the backing layer 20. These plastic layers as well as the front and back overlaminate layers 16, 18 are then die cut to an appropriate size. Standard identification cards are of a size of approximately 3⅜ inches by 2⅝ inches. During the die cutting step, the border material is cut to define a through passage into which the paper core element is later inserted.

Once the die cutting has been performed, the bottom transparent layer or overlaminate 18, the backing layer 20 and the border 24 are fused together by heat and pressure treatment to form a single component. The top overlaminate layer 16 is only bonded to the border material 24 along a top most edge portion to create a flap 30 (FIG. 5) which can be lifted away from the remaining portion of the card so that the paper core, as well as the picture 12, can be inserted.

Typically, the photograph will be taken and the information printed onto the paper core 26 at a separate location. The user performs these tasks, cuts the photograph to size, places the core and photograph inside the border 24 and laminates the card by heat and pressure sealing the overlaminate 16 to the border 24 and enclosed core element 26 using a machine specifically constructed for this purpose.

Multiple layers of opaque backing material 20 are utilized to control the thickness of the identification card 10. Thus, if a thicker card is desired, the opaque backing layers could be ganged together as seen in FIG. 5 to increase the thickness. Thickness control is important when the card is to be inserted into mechanisms such as automatic bank tellers which accept and read only cards of a specified thickness.

It should be appreciated from the above that the invention has been described with a degree of particularity. Various modifications and/or alterations are possible. Thus, the picture 12 could be deleted and the core layer 22 could include only the border 24 and paper core 26. It should also be appreciated that in the event no printing or magnetic identification is required on the back surface of the card 10, the bottom most transparent layer 18 could be omitted. In this event, the opaque plastic backing layer 20 could be made from a single layer of polyester and a single layer of polyethylene adhesive material.

It should be appreciated therefore that these and other alterations and/or modifications apparent to the skilled artesian are to be protected and any such modification falling within the spirit or scope of the appended claims is to be covered by the present invention.

I claim:

1. An identification card comprising:

a flexible paper core to which identifying indicia can be affixed, said paper core including a layer of safety paper mounted to a layer of backing paper;

a polyester border which defines an inner surface that abuts and bounds an outer periphery of said paper core, said border having a thickness substantially the same as said paper core;

an opaque flexible polyester backing layer having an outer perimeter the same dimensions as an outer perimeter of said border and having a backing surface to which said paper core and polyester border are bonded; and a polyester covering layer of sufficient transparency to allow said indicia to be viewed through said covering layer; said covering layer including a bonding surface to bond said border and safety paper core to said covering layer thereby sealing said paper core.

2. The card of claim 1 wherein said core comprises bank note paper.

3. The card of claim 1 wherein said paper core defines an opening to position an identifying photograph.

4. The identifying card of claim 1 wherein said border comprises a polyester inner layer bonded by two polyethylene outer layers which, when heated, help bond said border to the backing and the covering layers.

5. The card of claim 1 which comprises a plurality of opaque flexible backing layers which, in addition to the border and covering layer, define the thickness of said card.

6. An identification card comprising:

a flexible paper core including a layer of safety paper to which identifying indicia is applied and one or more layers of backing paper to mount the layer of safety paper;

a thin flexible polyester backing having at least one surface covered with a layer of polyethylene to which said backing paper is bonded;

a polyester border material which abuts the periphery of said flexible paper core and has the same thickness as said paper core, said border having an outside edge of the same outer dimensions as said backing; and a polyester cover material bonded to said border and said core, said cover of sufficient transparency to allow indicia applied to said safety paper to be discerned.

said cover material including an inner polyethylene layer to bond said border and said paper core to said cover under heat treatment and thereby encapsulate the flexible paper core.

7. The card of claim 6 wherein said backing has printing affixed to an opposite surface from said core and which further comprises a cover material bonded to said opposite surface similar to said cover material which covers said core.

8. An identification card comprising:

a first core layer including a polyester border, a flexible safety paper core having a layer of safety paper and at least one flexible backing layer bonded to said safety paper bounded by said border and a picture bounded by said paper, all of approximately the same thickness;

a second flexible polyester core layer abutting said first core layer having a surface contacting said first core layer covered with polyethylene which, when heated, adheres to said first core layer; and a pair of outer transparent polyester layers each having an inner surface covered with polyethylene which adheres to exposed surfaces of said first and second core layers when pressure and heat treated.

9. The card of claim 8 which comprises multiple flexible polyester core layers in addition to said first core layer; said multiple layers defining the thickness of said identification card.

10. An identification card comprising:

a flexible paper core including a layer of safety paper to which identifying indicia is applied and a layer of manifold backing paper bonded to the layer of safety paper by a layer of dry mount tissue;

a thin flexible polyester backing having an inner layer of polyethylene to which said backing paper is bonded;

a polyester border which abuts the periphery of said flexible paper core and has the same thickness as said paper core, said border having an outside edge of the same outer dimensions as said backing and is bonded to the polyester backing by the inner layer of polyethylene of said polyester backing; and a polyester cover material bonded to said border and said paper core, by an inner layer of polyethylene, said cover of sufficient transparency to allow indicia applied to said safety paper to be discerned.

* * * * *